US009550589B2

(12) United States Patent
Jäppi et al.

(10) Patent No.: US 9,550,589 B2
(45) Date of Patent: Jan. 24, 2017

(54) METHOD FOR FASTENING A PAPER PRODUCT ROLL ENTITY TO A PALLET AND A PAPER PRODUCT ROLL ENTITY WRAPPED BY PLASTIC FOIL

(75) Inventors: Juha Jäppi, Aitoo (FI); Matti Haloila, Naantali (FI)

(73) Assignees: UPM RAFLATAC OY, Tampere (FI); OCTOMECA OY, Naantali (FI)

( * ) Notice: Subject to any disclaimer, the term of this patent is extended or adjusted under 35 U.S.C. 154(b) by 80 days.

(21) Appl. No.: 12/000,428

(22) Filed: Dec. 12, 2007

(65) Prior Publication Data

US 2008/0209862 A1 Sep. 4, 2008

Related U.S. Application Data

(60) Provisional application No. 60/874,274, filed on Dec. 12, 2006.

(51) Int. Cl.

*B65B 11/00* (2006.01)
*B65D 19/44* (2006.01)
*B65D 71/00* (2006.01)

(52) U.S. Cl.

CPC ..... *B65B 11/00* (2013.01); *B65D 19/44* (2013.01); *B65D 71/0088* (2013.01); *B65D 2519/00815* (2013.01); *B65D 2571/00018* (2013.01)

(58) Field of Classification Search

CPC ..... B65B 11/00; B65D 2519/00815; B65D 2571/00018; B65D 71/0088
USPC ..... 53/587, 399, 557, 556, 441, 461; 100/2, 100/24; 206/386
See application file for complete search history.

(56) References Cited

U.S. PATENT DOCUMENTS

| | | | | |
|---|---|---|---|---|
| 4,119,023 | A * | 10/1978 | Boe et al. | 100/2 |
| 4,206,846 | A * | 6/1980 | Connolly | 206/597 |
| 4,235,062 | A * | 11/1980 | Lancaster et al. | 53/399 |
| 5,761,881 | A * | 6/1998 | Wall | 53/415 |
| RE37,575 | E * | 3/2002 | Lambert | 206/597 |
| 6,516,591 | B1 * | 2/2003 | Lancaster et al. | 53/556 |
| 6,564,532 | B2 * | 5/2003 | Gutche | 53/556 |
| 6,775,956 | B1 * | 8/2004 | Lacey | 53/399 |
| 2002/0033002 | A1 * | 3/2002 | Lachenmeier et al. | 53/442 |
| 2002/0062630 | A1 | 5/2002 | Gutche | |
| 2003/0208994 | A1 * | 11/2003 | Gooding et al. | 53/557 |
| 2005/0210841 | A1 * | 9/2005 | Hannen | 53/567 |

(Continued)

FOREIGN PATENT DOCUMENTS

DE 20203817 U1 7/2003

OTHER PUBLICATIONS

European Search Report—April 22, 2008.

*Primary Examiner* — Anthony Stashick
*Assistant Examiner* — Raven Collins
(74) *Attorney, Agent, or Firm* — Cantor Colburn LLP

(57) ABSTRACT

A method for fastening a paper product roll entity to a pallet by continuous plastic foil. The pallet has a cross direction and a longitudinal direction. A first sequence is repeated at least once. The first sequence includes wrapping the paper product roll entity such that a first continuous foil unwound from a foil head travels over the paper product roll entity and under the pallet, and moving in a cross direction a head of the foil or the pallet having the paper product roll entity on its substantially horizontal plane. After the first sequence, a second sequence is repeated at least once. The second sequence includes wrapping a second continuous foil spirally around the paper product roll entity.

24 Claims, 4 Drawing Sheets

(56) References Cited

U.S. PATENT DOCUMENTS

| | | | | |
|---|---|---|---|---|
| 2006/0131405 | A1* | 6/2006 | Schneider | 235/385 |
| 2006/0207307 | A1 | 9/2006 | Hofuku et al. | |
| 2006/0260279 | A1* | 11/2006 | Jafari | 53/399 |

* cited by examiner

METHOD FOR FASTENING A PAPER PRODUCT ROLL ENTITY TO A PALLET AND A PAPER PRODUCT ROLL ENTITY WRAPPED BY PLASTIC FOIL

CROSS-REFERENCE TO RELATED APPLICATIONS

This application claims priority to U.S. provisional patent application 60/874,274 filed 12 Dec. 2006, the entire contents of the disclosure of which is hereby incorporated by reference.

FIELD OF THE INVENTION

The present invention relates to a method for fastening a paper product roll entity onto a pallet and a paper product roll entity wrapped by plastic foil.

BACKGROUND OF THE INVENTION

The methods of prior art comprise methods which use strapping steel for fastening a paper roll onto a pallet.

SUMMARY OF THE INVENTION

The method is intended for replacing conventional packaging methods, such as methods which use e.g. strapping steel.

The novel method provides a safe and reliable package. The package is also simple and cheap. The packaging material can be recycled and reduced. Further, the packaged product is very well shielded inside the package.

In this application, the paper product roll entity may be

- a single roll comprising a paper product in web form,
- a stack of rolls comprising superimposed rolls which contain a paper product in web form, or
- more than one stack of rolls comprising superimposed rolls which contain a paper product in web form.

The paper product may be, for example, a label laminate comprising a release web, e.g. release paper, and labels or a face web, e.g. face paper, adhesively attached to the release web.

First, the paper product roll entity is placed on a pallet. If there are more than one stack of rolls, they are placed substantially near each other. The pallet comprises a substantially horizontal plane onto which the paper product roll entity is placed. The central axis of each roll of the entity is perpendicular to the horizontal plane. The horizontal plane may be built of parallel boards. Alternatively, the central axis of the roll may be parallel to the horizontal plane, i.e. the roll lies on the pallet.

The pallet has a longitudinal direction and a cross direction. The longitudinal direction of the pallet is typically the longitudinal direction of the parallel boards. Underneath the horizontal plane there is a base through which forks of a forklift can be pushed. The base comprises apertures which extend in the longitudinal direction of the pallet.

The method may be applied at two separate wrapping stations, i.e. a first and a second wrapping station, or the method may be integrated in one wrapping step which takes place at one wrapping station. Typically, there are two wrapping stations.

The method comprises two sequences which are both repeated at least once. The first sequence is implemented at the first wrapping station and the second sequence is implemented at the second wrapping station.

In the beginning of the method, the paper product roll entity placed on the pallet is conveyed to the first wrapping station by a conveyor, such as a conveyor comprising sequential rotating rolls. Forks, which are similar to the forks of a forklift, are pushed through the base of the pallet, and the pallet is lifted up from the conveyor. The pallet is transferred by the forks to such a position in which there is free space under the pallet and a first foil head of the first wrapping station can circulate around the paper product roll entity and the pallet. A continuous plastic foil unwinds from the foil head.

During the first sequence the foil head travels around the pallet and over the first end of the paper product roll entity along a circular path so that the foil follow an aperture in the base of the pallet. The foil head may be suitably inclined so that the foil narrows when it travels through the aperture. The foil head may be circulated several times through the same aperture. Next, the pallet is transferred in the cross direction of the pallet so that the next aperture of the base is at the foil head. The wrapping operation is accomplished in the same way as in connection with the first aperture. The first sequence is repeated as many times as is necessary; The number of times depends, among others, on the number and the size of the rolls, and the number of the apertures underneath the pallet. It is possible that the pallet is transferred back and forth in the cross direction of the pallet in order to achieve a strong and tough multilayer plastic layer. Alternatively, the foil head may be transferred instead of the pallet while the pallet is kept stationary. In that case, it is possible that only the foil head moves, or the whole wrapping device moves. When the required layer has been formed, the foil is cut and the pallet with the paper product roll entity is transferred to the second wrapping station. The paper product roll entity may be transferred for example so that the pallet is laid down by the forks on a conveyor which conveys the pallet automatically to the next wrapping station.

Some pallets do not contain any apertures. In that case the foil is wrapped against the bottom of the pallet.

At the next, i.e. the second wrapping station, a continuous foil is wrapped spirally around the paper product roll entity. The continuous foil unwinds from a second foil head. The spirally advancing foil tightens the foil which has been wrapped around the pallet and the paper product roll entity at the first wrapping station. The wrapping operation may advance from below upwards or vice versa. Typically, the wrapping operation starts from below. It is possible that the wrapping operation starts (or ends) from such a low level that also the pallet is wrapped at least partially. In order to achieve a plastic layer which is adequately strong and tough it may be necessary to repeat the wrapping operation several times. After the wrapping operation has been finished the second foil is cut.

The first and the second foils are plastic foils which are adequately strong and tough. They may be made, for example, of polyethylene.

BRIEF DESCRIPTION OF THE DRAWINGS

In the following, the method will be explained by referring to the following figures in which.

DETAILED DESCRIPTION OF EMBODIMENTS OF THE INVENTION

Figure 1:
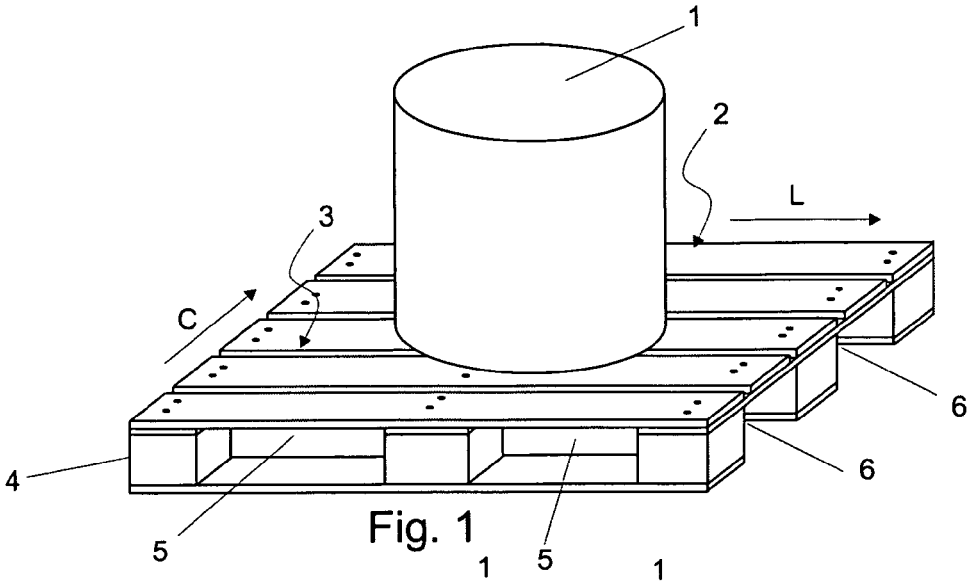
FIGS. 1 to 3 show a pallet and a paper product roll entity on the surface of the pallet in a perspective view.
Figure 2:
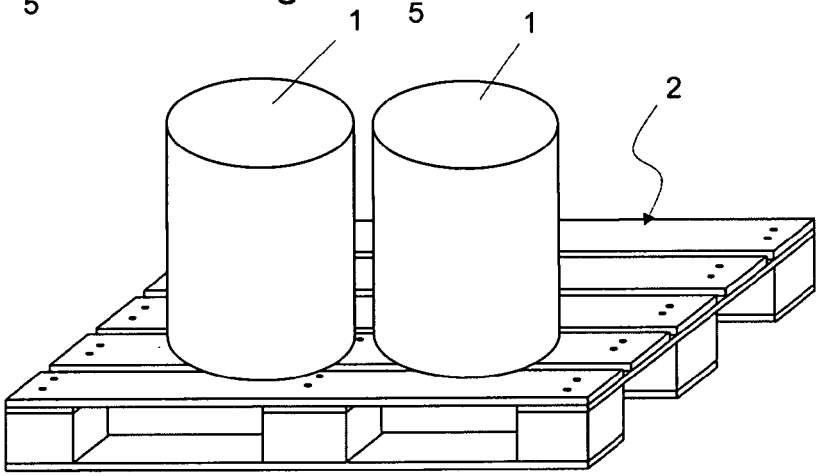
Figure 3:
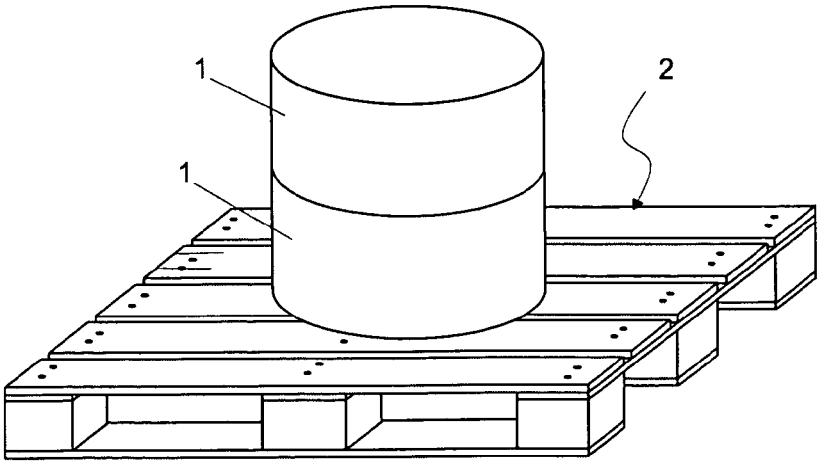

FIGS. 1 to 3 show a pallet 2 and a paper product roll entity on the surface of the pallet 2 in a perspective view. The paper product roll entity may consist of a single roll 1, as shown in FIG. 1, or the paper product roll entity may comprise two or more rolls, as shown in FIG. 2. The rolls 1 may also be stacked, as shown in FIG. 3. The number of the stacked rolls can vary from two to several rolls. All of the above mentioned variables are possible, and further, any combination of those variables is feasible.

Referring now to FIG. 1, the parts of the pallet will be described. The pallet 2 has a longitudinal direction L and a cross direction C. The pallet 2 comprises a horizontal plane 3 onto which the paper product roll entity is placed. Underneath the horizontal plane 3 there is a base 4. The base 4 comprises apertures 6 which extend in the longitudinal direction L of the pallet 2. The base also comprises passages 5 in which forks of a forklift can be pushed.

Figure 4:
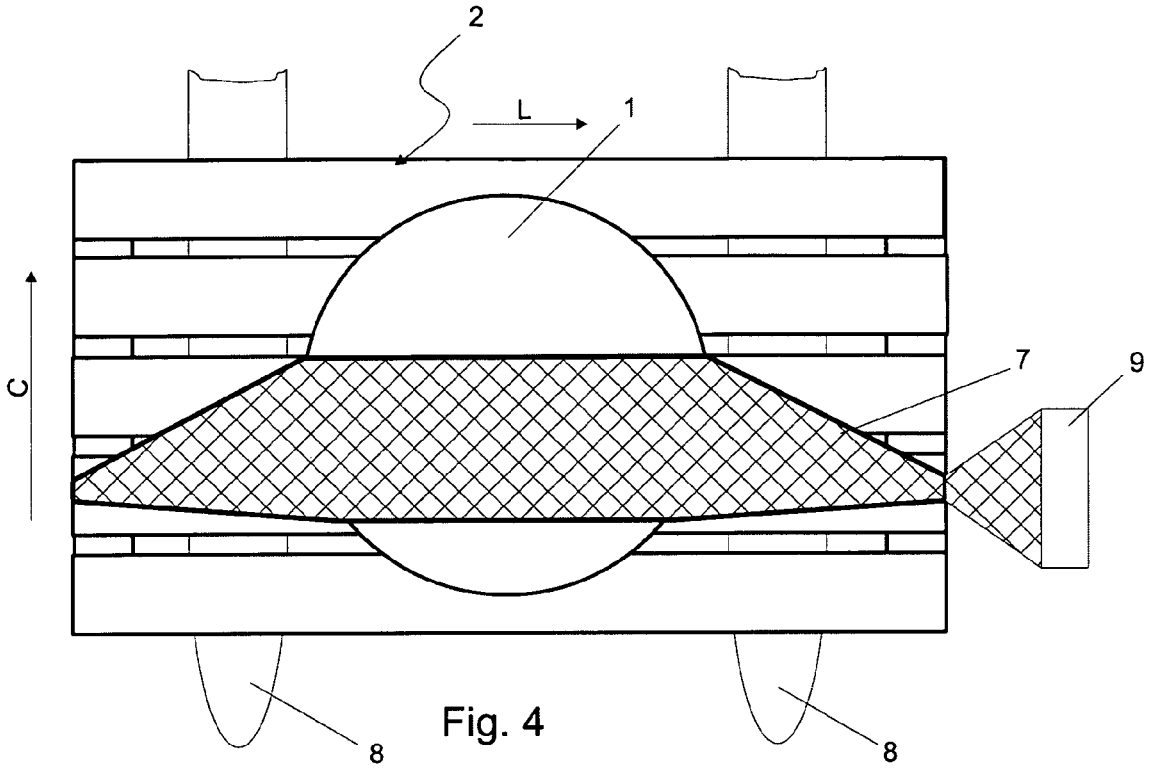
FIGS. 4 to 5 show a pallet and a paper product roll entity from above.
Figure 5:
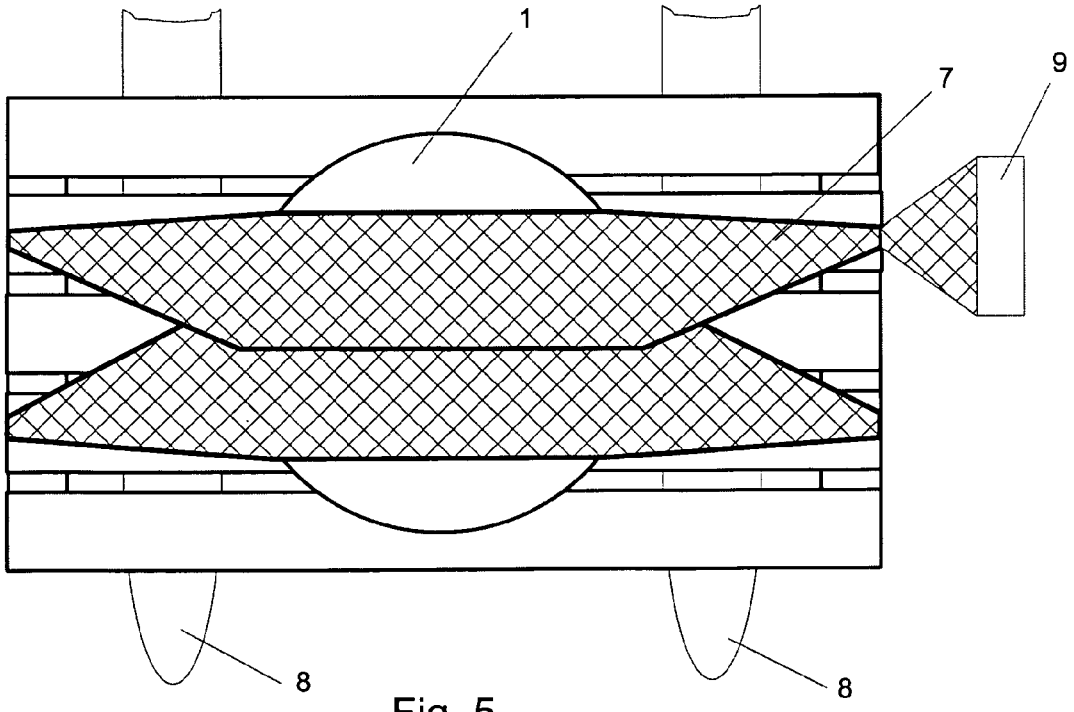

FIGS. 4 and 5 show a pallet 2 and a paper product roll entity, in this case a roll 1, from above. The pallet 2 has been lifted up by forks 8 so that there is space for a foil head 9 to move under the pallet 2. The pallet 2 is transferred by the forks 8 so that one of the apertures 6 is at the foil head 9. The foil head 9 is adapted to circulate around the pallet 2 and the roll 1 along a circular loop so that the foil 7 travels via an aperture 6 and above the end of the roll 1 which is facing upwards. The foil 7 is made narrower when it passes the aperture 6 by inclining the foil head 9. It depends on the desired strength how many times the foil 7 is wound around the pallet 2 and the paper product roll entity. Typically, there are 4 to 6 layers on top of each other.

After the adequate layers have been formed, the pallet 2 is transferred in the cross direction C so that the next aperture 6 is at the foil head 9 (see FIG. 5). The foil head 9 is adapted to circulate around the pallet 2 and the paper product roll entity in the same way as described above. The wrapping—transferring sequence is repeated as many times as desired. The number of times depends, for example, on the number of the apertures 6, but all the apertures 6 are not necessarily used. On the other hand, it is possible that the pallet 2 is transferred back and forth when the number of the repeated sequences is greater that the number of the apertures 6.

Figure 6:
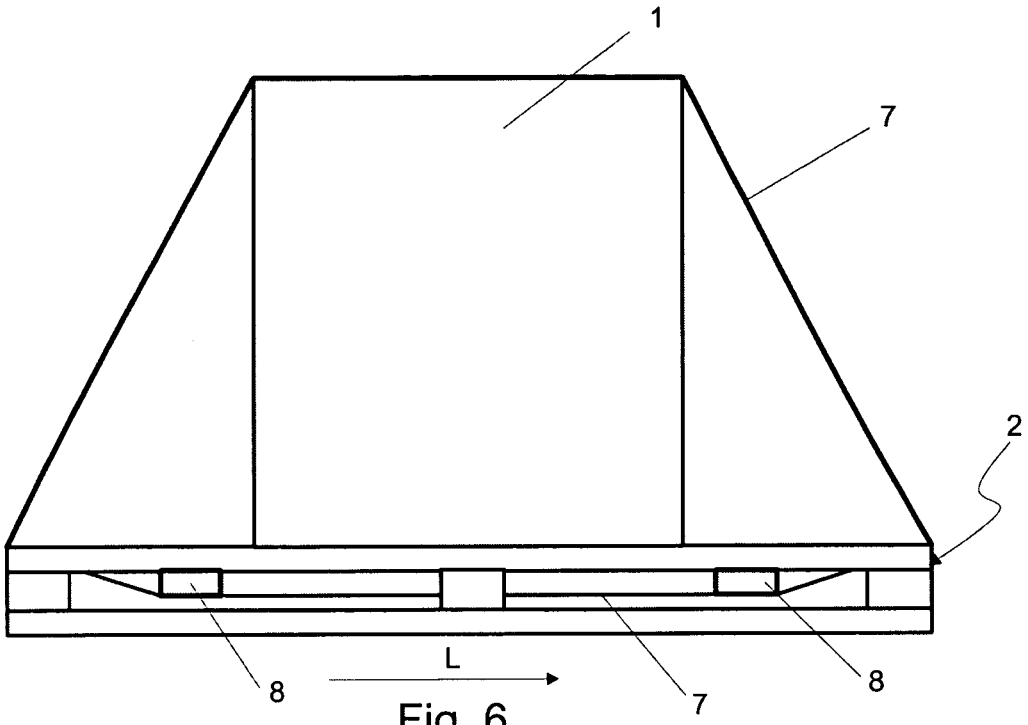
FIGS. 6 to 7 show a side-view of a pallet and a paper product roll entity, and FIG. 8 show a pallet and a paper product roll entity on the surface of the pallet in a perspective view.

FIG. 6 shows a side-view of the pallet 2 and the roll 1 after the first sequence at the first wrapping station. The foil 7 covers at least partially the end of the roll 1 which faces upwards and is wound around the pallet 2 via the apertures 6. The forks 8 remain inside the ring which is formed of the foil 7. In the end of the first sequence the foil 7 is cut off.

After the first sequence at the first wrapping station has been finished, the pallet 2 is released from the forks 8 to the conveyor, and the pallet 2 and the roll 1 are conveyed to the second wrapping station. The second sequence is accomplished at the second wrapping station.

Figure 7:
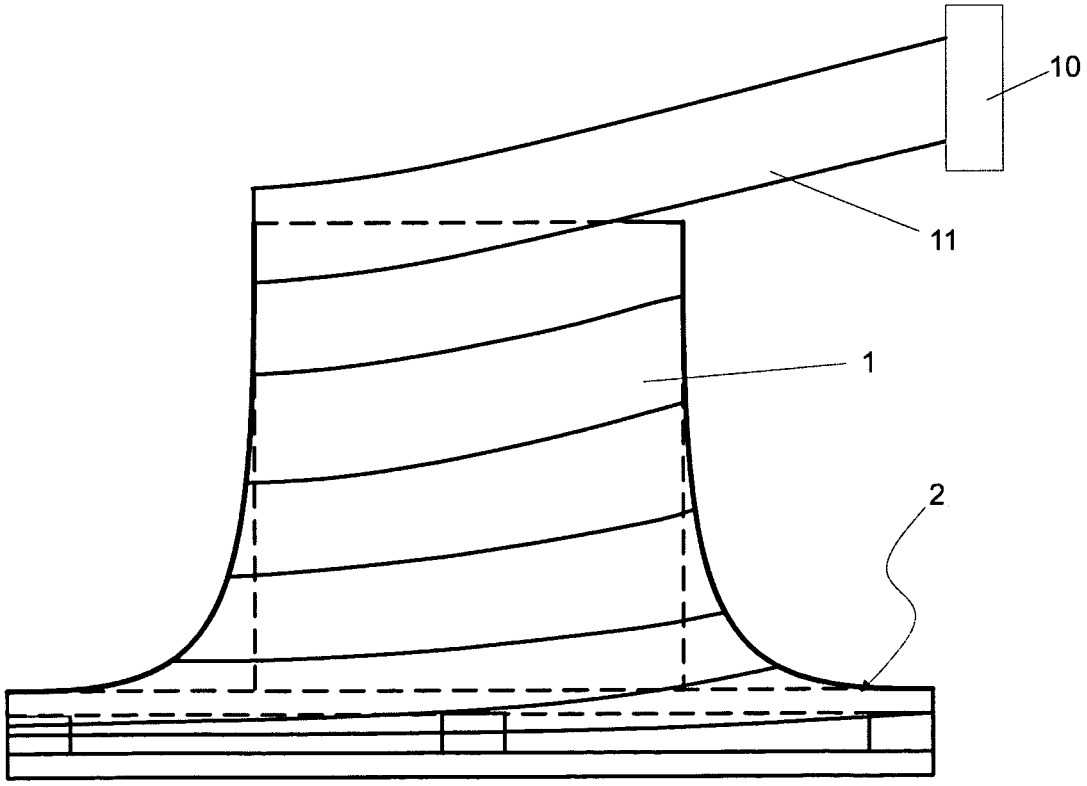

A foil head 10 is adapted to travel spirally around the pallet 2 and the roll 1. The second sequence typically starts from under but it is also possible that the second sequence starts from above. Further, the foil 11 may form several spirally wrapped layers. The foil 11 tightens the foil 7 so that the roll 1 is fastened firmly to the pallet 2. The tightening effect of the foil 11 can be seen from FIGS. 6 and 7. In FIG. 6, the foil 7 is straight but in FIG. 7 it is curved. The method shown in FIGS. 6 and 7 can also be applied to such a roll or rolls which lie on the horizontal plane of the pallet 2.

After the foil 11 has been wrapped adequately around the roll 1 and the foil 7, the foil 11 is cut. Thus, the package of the roll 1 is ready.

Figure 8:
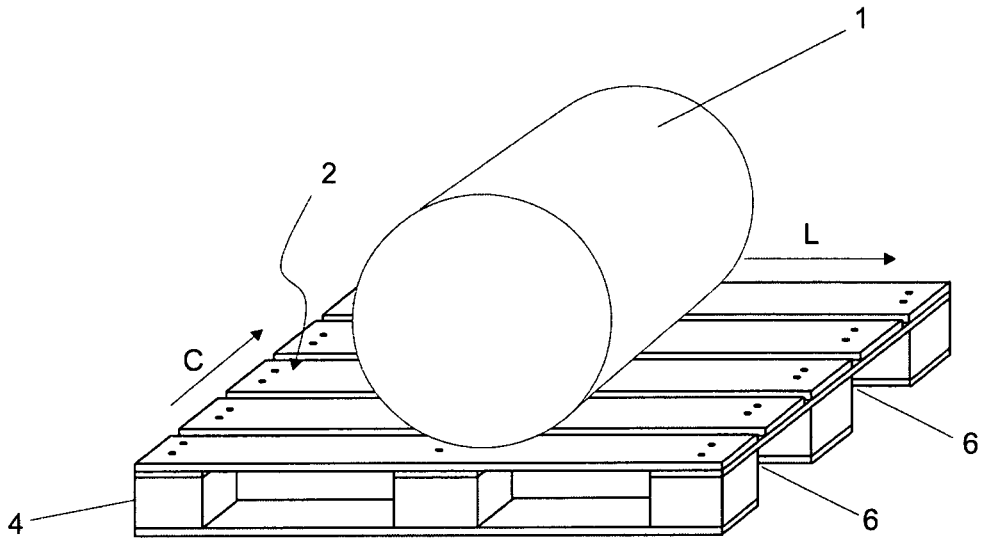

FIG. 8 show a pallet 2 and a paper product roll entity on the surface of the pallet 2 in a perspective view. In this case, the paper product roll entity is a single roll 1 which lies on the surface of the pallet 2. It is also possible that two or more rolls 1 lie on the surface of the pallet 2.

We claim:

1. A method for fastening at least one paper product roll entity or at least one stack of paper product roll entities to a pallet by continuous plastic foil, the pallet having a substantially horizontal planar supporting surface, a cross direction and a longitudinal direction, the method comprising:

carrying out at least twice a first sequence comprising:

wrapping the at least one paper product roll entity or the at least one stack of paper product roll entities so that a first continuous foil unwound from a foil head travels from an edge of the pallet to an edge or surface of the at least one paper product roll entity or an edge or surface of an uppermost roll of at the at least one stack of paper product roll entities over the at least one paper product roll entity or over the uppermost roll of the at least one stack of paper product roll entities, and from the edge or surface of the at least one paper product roll entity or the edge or surface of the uppermost roll of at the at least one stack of paper product roll entities to the edge of the pallet and under the pallet, such that a spacing exists between the foil and the paper product roll or paper product roll entities in the vicinity of the pallet, and such that a volume is formed bounded by the foil, the paper product roll or paper product roll entities and the pallet, and moving in the cross direction of the pallet the foil head or the pallet having the at least one paper product roll entity or the at least one stack of paper product roll entities on the substantially horizontal planar supporting surface, carrying out at least once after the first sequence a second sequence comprising:

wrapping a second continuous foil spirally around the at least one paper product roll entity or the at least one stack of paper product roll entities, such that the volume decreases, wherein at least one aperture is defined underneath of the substantially horizontal planar supporting surface of the pallet and extends in the longitudinal direction of the pallet, and wherein the first continuous foil travels through the at least one apertures and over the first end of the at least one paper product roll entity or over the first end of the uppermost roll of at least one stack of paper product roll entities.

2. The method according to claim 1, wherein the at least one paper product roll entity or the at least one stack of paper product roll entities stands on the substantially horizontal planar supporting surface of the pallet such that a central axis of the at least one paper product roll entity or central axes of the paper product roll entities in the at least one stack of paper product roll entities extends substantially perpendicularly to the substantially horizontal planar supporting surface, the first end of the at least one paper product roll entity or the first end of the uppermost roll of the at least one stack of paper product roll entities faces upwards and a second end of the at least one paper product roll entity or a second end of a lowest roll of the at least one stack of paper product roll entities faces the substantially horizontal planar supporting surface.

3. The method according to claim 1, wherein the first sequence takes place on a first wrapping station.

4. The method according to claim 1, further comprising:

transferring the at least one paper product roll entity or at least one stack of paper product roll entities from the first wrapping station to a second wrapping station after the first sequence in order to accomplish the second sequence.

5. At least one paper product roll entity or at least one stack of paper product roll entities wrapped by plastic foil, comprising:

at least one paper product roll entity or at least one stack of paper product roll entities on a pallet having a substantially horizontal planar supporting surface, a cross direction and a longitudinal direction;

a continuous first foil wrapped around the at least one paper product roll entity or the at least one stack of paper product roll entities such that the continuous first foil extends from an edge of the pallet to an edge or surface of the at least one paper product roll entity or an edge or surface of an uppermost roll of at the at least one stack of paper product roll entities over the at least one paper product roll entity or over an uppermost roll of the at least one stack of paper product roll entities, from the edge or surface of the at least one paper product roll entity or the edge or surface of the uppermost roll of at the at least one stack of paper product roll entities to the edge of the pallet and under the pallet, such that a spacing exists between the foil and the paper product roll or paper product roll entities in the vicinity of the pallet, and such that a volume is formed bounded by the foil, the paper product roll or paper product roll entities and the pallet; and a second foil wrapped spirally around the at least one paper product roll entity or the at least one stack of paper product roll entities and the first foil, such that the volume has been decreased, wherein at least one apertures is defined underneath of the substantially horizontal planar supporting surface of the pallet and extends in the longitudinal direction of the pallet, and wherein the first continuous foil travels through the at least one apertures and over the first end of the at least one paper product roll entity or over the first end of the uppermost roll of at least one stack of paper product roll entities.

6. The paper product roll entity according to claim 5, wherein the paper product roll entity comprises the at least one paper product roll entity or the at least one stack of paper product roll entities stands on the substantially horizontal planar supporting surface of the pallet, wherein a central axis of the at least one paper product roll entity or central axes of the paper product roll entities in the at least one stack of paper product roll entities extends substantially perpendicularly to the substantially horizontal planar supporting surface of the pallet, wherein the first end of the at least one paper product roll entity or a first end of an uppermost roll of the at least one stack of paper product roll entities faces upwards and a second end of the at least one paper product roll entities or a second end of a lowest roll of the at least one stack of paper product roll entities faces the substantially horizontal planar supporting surface of the pallet.

7. The paper product roll entity according to claim 5, wherein the first and the second foils comprise polyethylene.

8. The paper product roll entity according to claim 5, wherein the second continuous foil has been wrapped about the at least one paper product roll entity or at least one stack of paper product roll entities and the pallet and onto the first continuous foil so tightly as to curve the first continuous foil.

9. The method according to claim 1, wherein the second continuous foil is wrapped about the at least one paper product roll entity or at least one stack of paper product roll entities and the pallet and onto the first continuous foil so tightly as to curve the first continuous foil.

10. The method according to claim 1, wherein the pallet has a width that is greater than a width of the at least one product roll entity or at least one stack of paper product roll entities.

11. The paper product roll entity according to claim 5, wherein the pallet has a width that is greater than a width of the at least one paper product roll entity or at least one stack of paper product roll entities.

12. The paper product roll entity according to claim 5, wherein the pallet comprises a plurality of leg members configured to support horizontal planar supporting surface of the pallet above a surface, and wherein the horizontal planar supporting surface of the pallet comprises a plurality of horizontal members operatively joined together.

13. The paper product roll entity according to claim 12, wherein the plurality of horizontal members extend in a first horizontal direction and are operatively joined together by a plurality of horizontal members extending in a second horizontal direction.

14. The method according to claim 1, further comprising:

arranging forks in passages disposed in a cross-direction under the pallet prior to wrapping the first continuous foil.

15. The method according to claim 1, further comprising:

narrowing the foil prior to traveling through the apertures.

16. The method according to claim 15, wherein the foil is narrowed by inclining the head.

17. The paper product roll entity according to claim 5, wherein the foil traveling through the apertures is narrowed.

18. A method for fastening at least one paper product roll entity or at least one stack of paper product roll entities to a pallet by continuous plastic foil, the pallet having a substantially horizontal planar supporting surface, a cross direction and a longitudinal direction, the method comprising:

carrying out at least twice a first sequence comprising:

wrapping the at least one paper product roll entity or the at least one stack of paper product roll entities so that a first continuous foil unwound from a foil head travels from an edge of the pallet to an edge or surface of the at least one paper product roll entity or an edge or surface of an uppermost roll of at the at least one stack of paper product roll entities over the at least one paper product roll entity or over the uppermost roll of the at least one stack of paper product roll entities, and from the edge or surface of the at least one paper product roll entity or the edge or surface of the uppermost roll of at the at least one stack of paper product roll entities to the edge of the pallet and under the pallet, such that a spacing exists between the foil and the paper product roll or paper product roll entities in the vicinity of the pallet, and such that a volume is formed bounded by the foil, the paper product roll or paper product roll entities and the pallet, wrapping the foil through apertures extending below the substantially horizontal planar supporting surface of the pallet in the longitudinal direction of the pallet, and moving in the cross direction of the pallet the foil head or the pallet having the at least one paper product roll entity or the at least one stack of paper product roll entities on the substantially horizontal planar supporting surface, and carrying out at least once after the first sequence a second sequence comprising:

wrapping a second continuous foil spirally around the at least one paper product roll entity or the at least one stack of paper product roll entities, such that the volume decreases, wherein the first continuous foil travels through two apertures, the apertures being defined underneath of the substantially horizontal planar supporting surface of the pallet and extend in the longitudinal direction of the pallet, and over the first end of the at least one paper product roll entity or over the first end of the uppermost roll of at least one stack of paper product roll entities.

19. The method according to claim 18, further comprising:

narrowing the foil prior to traveling through the apertures.

20. The method according to claim 1, wherein a planar face of the roll entities is arranged on the substantially horizontal planar supporting surface.

21. The method according to claim 1, wherein the roll entities are rollingly arranged on the substantially horizontal planar supporting surface such that a round side of the roll entities is arranged on the substantially horizontal planar supporting surface.

22. The method according to claim 1, wherein the roll entities are positioned on the substantially horizontal planar supporting surface separated from edges of the pallet.

23. The method according to claim 1, wherein during the first sequence the first continuous foil is wrapped in a vertical direction around the at least one paper product roll entity or the at least one stack of paper product roll entities, and during the second sequence the second continuous foil is wrapped in a horizontally spirally.

24. The method according to claim 1, wherein the at least one aperture is partially defined by a bottom of the substantially horizontal planar supporting surface.

* * * * *